US006638893B2

(12) United States Patent
Laney et al.

(10) Patent No.: US 6,638,893 B2
(45) Date of Patent: Oct. 28, 2003

(54) THERMAL DYE TRANSFER RECEIVER ELEMENT WITH MICROVOIDED SUPPORT

(75) Inventors: Thomas M. Laney, Spencerport, NY (US); Teh-Ming Kung, Rochester, NY (US); Jose L. Garcia, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 83 days.

(21) Appl. No.: 10/033,481

(22) Filed: Dec. 27, 2001

(65) Prior Publication Data

US 2003/0144146 A1 Jul. 31, 2003

(51) Int. Cl.[7] ..... B41M 5/035; B41M 5/38
(52) U.S. Cl. ..... 503/227; 428/212; 428/32.5
(58) Field of Search ..... 8/471; 428/212, 428/32.5; 503/227

(56) References Cited

U.S. PATENT DOCUMENTS 5,698,489 A 12/1997 Shirai et al. ..... 503/227
6,096,684 A 8/2000 Sasaki et al. ..... 503/227

FOREIGN PATENT DOCUMENTS

EP 0 582 750 2/1994 ..... 503/227

*Primary Examiner*—B. Hamilton Hess
(74) *Attorney, Agent, or Firm*—Arthur E. Kluegel

(57) ABSTRACT

Disclosed is a thermal dye-transfer dye-image receiving element comprising:

(a) a dye-receiving layer 1;

(b) beneath layer 1, a microvoided layer 2 containing a continuous phase polyester matrix having dispersed therein crosslinked organic microbeads, said layer having a void volume of at least 25% by volume; and (c) beneath layer 2, a microvoided layer 3 comprised of a continuous phase polyester matrix having dispersed therein non-crosslinked polymer particles that are immiscible with the polyester matrix of layer 3. The invention provides a receiver exhibiting an improved combination of dye-transfer efficiency and tear strength.

31 Claims, No Drawings

THERMAL DYE TRANSFER RECEIVER ELEMENT WITH MICROVOIDED SUPPORT

FIELD OF THE INVENTION

This invention relates to a thermal dye-transfer dye-image receiving element comprising an image receiving layer 1, beneath that a microvoided layer 2 comprising a continuous phase polyester matrix having dispersed therein crosslinked organic microbeads, and beneath the layer 2 a microvoided layer 3 comprising a continuous phase polyester matrix having dispersed therein non-crosslinked polymer particles that are immiscible with the polyester matrix.

BACKGROUND OF THE INVENTION

In recent years, thermal transfer systems have been developed to obtain prints from pictures that have been generated electronically. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. A color hard copy is thus obtained which corresponds to the original picture viewed on a screen. Further details of this process and an apparatus for carrying it out are set forth in U.S. Pat. No. 4,621,271.

Dye-receiving elements used in thermal dye transfer generally comprise a polymeric dye image-receiving layer coated on a support. Supports are required to have, among other properties, adequate strength, dimensional stability, and heat resistance. For reflective viewing, supports are also desired to be as white as possible. Cellulose paper and plastic films have been proposed for use as dye-receiving element supports in efforts to meet these requirements. Recently, microvoided films formed by stretching an orientable polymer containing an incompatible organic or inorganic material have been suggested for use in dye-receiving elements.

Various arrangements have been proposed to improve the imaging quality of dye image receiving layers in thermal dye-transfer elements. JP 88-198,645 suggests the use of a support comprising a polyester matrix with polypropylene particles as a dye donor element. EP 582,750 suggests the use of a non-voided polyester layer on a support.

U.S. Pat. No. 5,100,862 relates to microvoided supports for dye-receiving elements used in thermal dye transfer systems. Polymeric microbeads are used as void initiators in a polymeric matrix to enable higher dye transfer efficiency. A problem exists with such support, however, in that in order to attain the high level of voiding necessary for desired dye transfer efficiency, the volumetric loading of the microbeads needs to be above 25% by volume of the polymeric matrix. The degree of voiding is preferably from about 30 to 60 volume percent. At these levels of loading the tear strength of the film during manufacture is very low and results in very poor manufacturing efficiency due to tearing of the support.

U.S. Pat. No. 6,096,684 relates to porous polyester films suitable as supports for receiving elements used in thermal dye transfer systems. Polymers immiscible with a polyester are used in a base layer while an adjacent layer, upon which a dye receiving layer is formed, contains a polyester containing dispersed inorganic particles as void initiators. These inorganic particles are less than 1.0 $\mu$m in size. The porosity of layer (B) is specified to be not less than 20% by volume. This support solves the problem of poor adhesion of imaging layers to a support consisting only of layer (A). This support has also been shown to be manufacturable at high efficiency. A problem exists with this support, however, in that the hardness of the inorganic void initiators results in poor contact with the dye donor element. This results in low dye transfer efficiency for elements using such supports.

It would be desirable to have a dye image-receiving element for thermal dye transfer which exhibits both sufficient tear-resistance to be readily manufacturable and a high dye transfer efficiency.

SUMMARY OF THE INVENTION

The invention provides a thermal dye-transfer dye-image receiving element comprising:

(a) a dye-receiving layer 1;

(b) beneath layer 1, a microvoided layer 2 containing a continuous phase polyester matrix having dispersed therein crosslinked organic microbeads, said layer having a void volume of at least 25% by volume, and (c) beneath layer 2, a microvoided layer 3 comprised of a continuous phase polyester matrix having dispersed therein non-crosslinked polymer particles that are immiscible with the polyester matrix of layer 3. The invention provides a receiver exhibiting an improved combination of dye-transfer efficiency and tear strength.

DETAILED DESCRIPTION OF THE INVENTION

The invention is summarized above. The dye-receiving layer is any layer that will serve the function of receiving the dye transferred from the dye donor of the thermal element. Suitably it comprises a polymeric binder containing a polyester or a polycarbonate or a combination thereof. A desirable combination includes the polyester and polycarbonate polymers in a weight ratio of from 0.8 to 4.0:1.

A further desirable component of the dye-receiving layer is a polydimethylsiloxane-containing copolymer. Desirably, the polydimethylsiloxane-containing copolymer is a polycarbonate random terpolymer of bisphenol A, diethylene glycol, and polydimethylsiloxane block unit and is present in an amount of from about 10% to about 30% by weight of the said dye-receiving layer 1. The layer is typically further modified by the inclusion of plasticizing components to improve dye diffusion. Suitable such components include a mixture of 1,3-butylene glycol adipate and dioctyl sebacate (1:1 weight ratio), which is present in a total amount of from about 4% to about 20% by weight of the said dye-receiving layer 1.

The microvoided layer 2 desirably has a void volume of between 25% and 60 volume %, for example, with a void volume of between 25% and 50%, suitably between 40% and 50% being generally desirable. The continuous phase polyester of the microvoided layer 2 comprises any polyester and conveniently comprises polyethylene(terephthalate) or a copolymer thereof. Examples include a blend comprising polyethylene(terephthalate) and poly(1,4-cyclohexylene dimethyhlene terephthalate). In one useful embodiment, the layer 2 has dispersed therein crosslinked organic microbeads comprising at least one of a polystyrene, poly(methyl methacrylate), polyacrylamide, polyacrylonitrile, polyethylene glycol dimethacrylate, polyvinyl acetate, or polyvinylidene chloride. Microbeads comprising a polystyrene, polyacryl ate, polyallylic, or poly(methacrylate)polymer are conveniently useful.

The term microbead means polymeric spheres typically synthesized using the limited coalescence process. These microbead spheres can range in size from 0.2 to 30 micrometers. They are preferably in the range of 0.5 to 5.0 $\mu$m. The term voids or microvoids means pores formed in an oriented polymeric film during stretching. These pores are initiated by either inorganic particles, organic particles, or microbeads. The size of these voids is determined by the size of the particle or microbeads used to initiate the void and by the stretch ratio used to stretch the oriented polymeric film. The pores can range from 0.6 to 150 $\mu$m in machine and cross machine directions of the film. They typically range from 0.2 to 30 $\mu$m in height. Preferably the machine and cross machine direction pore size is in the range of 1.5 to 25 $\mu$m. Preferably the height of the pores is in the range of 0.5 to 5.0 $\mu$m.

The continuous phase polyester of the microvoided layer 3 comprises any polyester and conveniently comprises polyethylene(terephthalate) or a copolymer thereof. The immiscible particles are suitably particles based on a polyolefin having an olefinic backbone. Examples include polypropylene, polyethylene, and polystyrene, especially polypropylene. The microvoided layer 3 desirably has a density of less than 0.95 grams/cc and, more typically, a density of between 0.4 and 0.85 grams/cc. The microvoided layer 3 desirably has a void volume of greater than 30 volume % with a void volume of 35–55% being typical.

If desired, the layer 3 may be disposed on a further support such as a paper support. Layers 1, 2, and 3 together usually exhibit a total thickness of from 20 to 400, with values of 30–300 or 50–200 micrometers being typical. Depending on the manufacturing method employed and desired finished properties, the element may include one or more subbing layers between the layers. Such layers may be employed for any of the known reasons such as adhesion or antistatic properties. It is also possible to employ no subbing layer between layer pairs, particularly where coextusion of the adjacent layers is employed.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference. Specific examples of such dyes include the following:

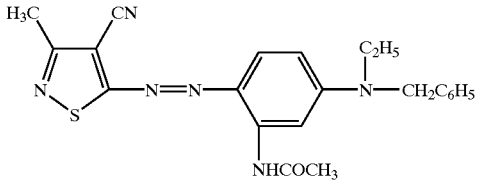

Magenta Dye M-1

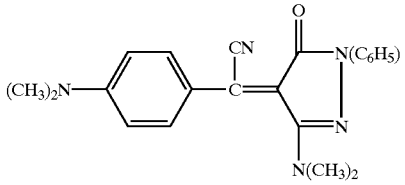

Magenta Dye M-2

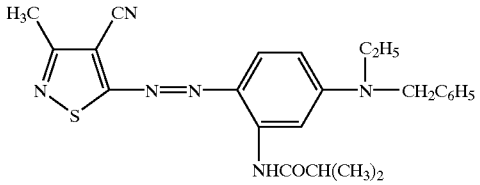

Magenta Dye M-3

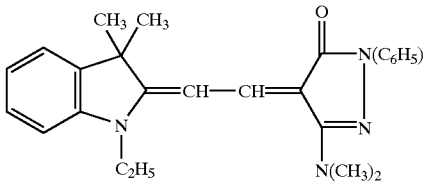

Yellow Dye Y-1

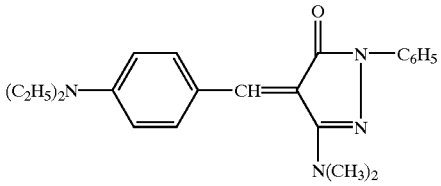

Yellow Dye Y-2

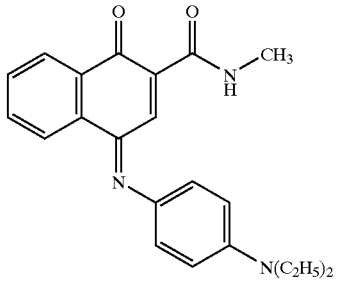

Cyan Dye C-1

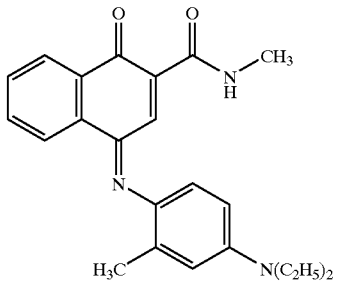

Cyan Dye C-2

-continued

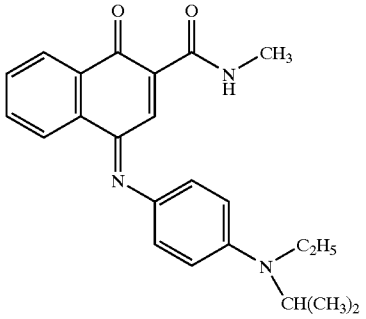

Cyan Dye C-3

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained. The dye-donor element may also contain a colorless area which is transferred to the receiving element to provide a protective overcoat. This protective overcoat is transferred to the receiving element by heating uniformly at an energy level equivalent to about 85% of that required to print maximum image dye density.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

EXAMPLES

Preparation of Microvoided Film Supports

Example 1

A Leistritz 27 mm Twin Screw Compounding Extruder heated to 275° C. was used to mix 1.7 μm poly (methylmethacrylate) beads crosslinked 30% with divinylbenzene and a 1:1 blend of poly(ethylene terephthalate) ("PET", commercially available as #7352 from Eastman Chemicals) and PETG 6763 (polyester copolymer(poly(1,4-cyclohexylene dimethylene terephthalate)) from Eastman Chemicals). All components were metered into the compounder and one pass was sufficient for dispersion of the beads into the polyester matrix. The microbeads were added to attain a 30% by volume loading in the microbeads. The compounded material was extruded through a strand die, cooled in a water bath, and pelletized. The pellets were then dried in a desiccant dryer at 65° C. for 12 hours.

Then PET (#7352 from Eastman Chemicals) was dry blended with polypropylene("PP", Huntsman P4G2Z-073AX) at 25% volume and dried in a desiccant dryer at 65° C. for 12 hours.

Cast sheets were co-extruded to produce a combined layer 2/layer 3 structure using a 2½" extruder to extrude the PET/PP blend, layer (3) and a 1" extruder to extrude the compounded pellets, layer (2). The 275° C. melt streams were fed into a 7 inch multi-manifold die also heated at 275° C. As the extruded sheet emerged from the die, it was cast onto a quenching roll set at 55° C. The PP in the PET matrix of layer (3) dispersed into globules between 10 and 30 μm in size during extrusion. The final dimensions of the continuous cast sheet were 18 cm wide and 480 μm thick. Layer (3) was 350 μm thick while layer (2) was 130 μm thick. The cast sheet was then stretched at 110° C. first 3.0 times in the X-direction and then 3.4 times in the Y-direction. The stretched sheet was then Heat Set at 150° C.

Example 2

Another sample was also evaluated in which 5.0 μm polystyrene beads crosslinked 30% with divinylbenzene were used in place of the 1.7 micrometer poly (methylmethacrylate) beads. These beads were added to attain 20% by volume loading in the same polyester matrix as example 1. The final dimensions of the continuous cast sheet were 18 cm wide and 1323 μm thick. Layer (3) was 1243 μm thick while layer (2) was 80 μm thick. The sample was stretched the same as Example 1.

Comparative 1

A control sample was also evaluated in which 0.7 micrometer $BaSO_4$ particles were used in place of the 1.7 micrometer poly(methylmethacrylate) beads of Example 1. The $BaSO_4$ was also added at 30% by volume loading in the same polyester matrix as example 1. The final dimensions of the continuous cast sheet were 18 cm wide and 1310 μm thick. Layer (3) was 1245 μm thick while layer (2) was 65 μm thick. The sample was stretched the same as Example 1.

Comparative 2

A control sample was also evaluated in which a Leistritz 27 mm Twin Screw Compounding Extruder heated to 275° C. was used to mix 1.7 μm poly(methylmethacrylate) beads crosslinked 30% with divinylbenzene and a 1:1 blend of poly(ethylene terephthalate)("PET", commercially available as #7352 from Eastman Chemicals) and PETG 6763 (polyester copolymer from Eastman Chemicals). All components were metered into the compounder and one pass was sufficient for dispersion of the beads into the polyester matrix. The microbeads were added to attain a 30% by volume loading in the microbeads. The compounded material was extruded through a strand die, cooled in a water bath, and pelletized. The pellets were then dried in a desiccant dryer at 65° C. for 12 hours.

Cast sheets were extruded into a mono-layer film (layer (2) only) using a 2½" extruder to extrude the compounded pellets. The 275° C. melt stream was fed into a 7 inch single-manifold die also heated at 275° C. As the extruded sheet emerged from the die, it was cast onto a quenching roll set at 55° C. The final dimensions of the continuous cast sheet were 18 cm wide and 255 μm thick. The cast sheet was then stretched at 110° C. first 3.0 times in the X-direction and then 3.4 times in the Y-direction. The stretched sheet was then Heat Set at 150° C.

Comparative 3

Another control sample as in Comparative 2 was evaluated in which the 1.7 um poly(methylmethacrylate) beads crosslinked 30% with divinylbenzene were added at 30 volume percent loading. The final dimensions of the continuous cast sheet were 18 cm wide and 225 μm thick. An attempt was made to stretch the sample the same as Comparative 2 but continuous tears while stretching occurred. The cast sheet was deemed non-manufacturable.

Comparative 4

Another control sample as in Comparative 2 was evaluated in which the 1.7 μm poly(methylmethacrylate) beads were replaced by 5.0 μm polystyrene beads crosslinked 30% with divinylbenzene. These beads were added at 25 volume percent loading. The final dimensions of the continuous cast sheet were 18 cm wide and 235 μm thick. An attempt was made to stretch the sample the same as Comparative 2 but continuous tears while stretching occurred. The cast sheet was deemed non-manufacturable.

Table 1 shows the resultant stretched film thicknesses of all samples.

TABLE 1

MICROVOIDED FILM DESCRIPTION

| Sample | Stretched Thickness (μm) (Layer 3/Layer 2) | Matrix Material Layer 2 | Matrix Material Layer 3 | Void Initiator Layer 2 Vol. Load/Material/Size | Void Initiator Layer 3 Vol. Load/Material/Size |
|---|---|---|---|---|---|
| Ex. 1 | 58/24 | 50% PET/ 50% PETG | PET | 30%/PMMA/ 1.7 μm | 25%/PP/10–30 μm |
| Ex. 2 | 203/12 | 50% PET/ 50% PETG | PET | 20%/PS/5.0 μm | 25%/PP/10–30 μm |
| Comp 1 | 203/12 | 50% PET/ 50% PETG | PET | 30%/$BaSO_4$/ 0.7 μm | 25%/PP/10–30 μm |
| Comp 2 | NA/50.0 | 50% PET/ 50% PETG | NA | 20%/PMMA/ 1.7 μm | NA |
| Comp 3 | NA/50.0* | 50% PET/ 50% PETG | NA | 30%/PMMA/ 1.7 μm | NA |
| Comp 4 | Na/50.0* | 50% PET/ 50% PETG | NA | 25%/PS/5.0 μm | NA |

*This was the intended thickness if samples were manufacturable

Preparation of Dye-Receiving Elements for Example 1 and Comparative 2

A thermal dye-receiving element was prepared from the above receiver support by coating the following layers in order to the top surface (layer 2) of the microvoided film:

a) a subbing layer containing Prosil 221 (0.055 g/m$^2$) and Prosil 2210 (0.055 g/m$^2$) (PCR Inc.) (both are organo-oxysilanes) along with LiCl (0.0033 g/m$^2$) in an ethanol-methanol-water solvent mixture. The resultant solution (0.1133 g/m$^2$) contained approximately 1% of silane component, 1% water and 98% of 3A alcohol.

b) A dye-receiving layer containing a random terpolymer of bisphenol A polycarbonate (50 mole %), diethylene glycol (49 mole %) and polydimethylsiloxane (1 mole %) (2500 MW) block units (0.48 g/m$^2$), a random polyester terpolymer of 1,4-cyclohexyleneterephthalate, ethylene glycol, and 4,4'-bis(hydroxyethyl)bispbenol A (2.00 g/m$^2$), GE Lexan 141-112 (a bisphenol A polycarbonate) (General Electric Co.) (0.08 g/m$^2$), Drapex 429 polyester plasticizer (Witco Corp.) (0.08 g/m$^2$), dioctyl sebacate (Aldrich Co.) (0.20 g/m$^2$), and FLUORAD FC-431 (a perfluorinated alkylsulfonamidoalkylester surfactant)(3M Co.) (0.011 g/m$^2$), and was coated from a solvent mixture of dichloromethane and trichloroethylene.

Preparation of Dye-Receiving Elements for Example 2 and Comparative 1

A thermal dye-receiving element was prepared from the above receiver support by coating the following layers in order to the top surface (layer 2) of the microvoided film:

c) a subbing layer containing Prosil 221 (0.055 g/m$^2$) and Prosil 2210(0.055 g/m$^2$) (PCR Inc.) (both are organo-oxysilanes) along with LiCl (0.0033 g/m$^2$) in an ethanol-methanol-water solvent mixture. The resultant solution (0.1133 g/m$^2$) contained approximately 1% of silane component, 1% water and 98% of 3A alcohol.

d) A dye-receiving layer containing a random terpolymer of bisphenol A polycarbonate(50 mole %), diethylene glycol (49 mole %)and polydimethylsiloxane (1 mole %) (2500 MW) block units (0.66 g/m$^2$), a random polyester terpolymer of 1,4-cyclohexylterephthalate, ethylene glycol, and 4,4"-bis(hydroxyethyl)bisphenol A (1.74 g/m$^2$), GE Lexan 141-112 (a bisphenol A polycarbonate) (General Electric Co.) (1.43 g/m$^2$), Drapex 429 polyester plasticizer (Witco Corp.) (0.20 g/m$^2$), dioctyl sebacate (Aldrich Co.) (0.20 g/m$^2$), Tinuvin 123 (a hindered aminoether)(Ciba Chem. Co.) (0.40 g/m$^2$), and FLUORAD FC-431 (a perfluorinated alkylsulfonamidoalkylester surfactant)(3M Co.) (0.011 g/m$^2$), and was coated from a solvent mixture of dichloromethane and trichloroethylene.

Preparation of Dye-Donor Elements

The dye-donor used in the example is Kodak Ektatherm ExtraLife® donor ribbon.

Dye-Donor Element

A 4-patch protective layer dye-donor element was prepared by coating on a 6 μm poly(ethylene terephthalate) support:

1) a subbing layer of titanium alkoxide (DuPont Tyzor TBT)(® (0.12 g/m2) from a n-propyl acetate and n-butyl alcohol solvent mixture, and
2) a slipping layer containing an aminopropyldimethyl-terminated polydimethylsiloxane, PS513® (United Chemical Technologies, Inc.)(0.01 g/m2), a poly(vinyl acetal) binder, KS-1 (Sekisui Co.) (0.38 g/m2), p-toluenesulfonic acid (0.0003 g/m$^2$), polymethylsilsesquioxane beads 0.5 μm (0.06 g/m$^2$) and candellila wax. (0.02 g/m$^2$) coated from a solvent mixture of diethyl ketone and methanol.

On the opposite side of the support was coated:

1) a patch-coated subbing layer of titanium alkoxide (TyzorTBT)® (0.13 g/m$^2$) from a n-propyl acetate and n-butyl alcohol solvent mixture, and
2) repeating yellow, magenta and cyan dye patches containing the compositions as noted below over the subbing layer and a protective patch on the unsubbed portion as identified below.

The yellow composition contained 0.07 g/m$^2$ of the first yellow dye illustrated above, 0.09 g/m$^2$ of the second yellow dye illustrated above, 0.25 g/m$^2$ of CAP48220 (20 s viscosity) cellulose acetate propionate, 0.05 g/m$^2$ of Paraplex G-25® plasticizer and 0.004 g/m$^2$ divinylbenzene beads (2 μm beads) in a solvent mixture of toluene, methanol and cyclopentanone (66.5/28.5/5).

The magenta composition contained 0.07 g/m$^2$ of the first magenta dye illustrated above, 0.14 g/m$^2$ of the second magenta dye illustrated above, 0.06 g/m$^2$ of the third magenta dye illustrated above, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol and cyclopentanone (66.5/28.5/5).

The cyan composition contained 0.10 g/m$^2$ of the first cyan dye illustrated above, 0.09 g/m2 of the second cyan dye illustrated above, 0.22 g/m$^2$ of the third cyan dye illustrated above, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 μm beads) which was coated from a solvent mixture of diethylketone and isopropyl alcohol (80:20).

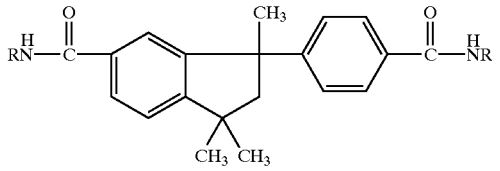

Monomeric Glass wherein R is

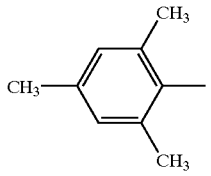

Evaluation of Dye-Transfer Printing Efficiency

An eleven-step sensitometric full color image was prepared from the above dye-donor and dye-receiver elements by printing the donor-receiver assemblage in a Kodak 8650 Thermal Printer. The dye-donor element was placed in contact with the polymeric receiving layer side of the receiver element. The assemblage was positioned on an 18 mm platen roller and a TDK LV5406A thermal head with a head load of 6.35 Kg was pressed against the platen roller. The TDK LV5406A thermal print head has 2560 independently addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.6 volts resulted in an instantaneous peak power of approximately 58.18× 10−3 Watt/dot and the maximum total energy required to print Dmax was 0.216 mJoules/dot. This printing process heated the laminate uniformly with the thermal head to permanently adhere the laminate to the print. The donor support was peeled away as the printer advanced through its heating cycle, leaving the laminate adhered to the imaged receiver.

After printing, Status A reflection densities of the 11-stepped image were measured with an X-Rite Model 820 densitometer (X-Rite Corp., Grandville, Michigan). The $OD_{max}$ and $OD_{mid}$ of yellow, magenta and cyan colors (Status A reflection densities at step 1 and step 4, respectively) are shown in Table 2.

TABLE 2

DYE TRANSFER EFFICIENCY

| Sample | Layer 2 Void Volume | Layer 3 Void Volume | Tearability | $OD_{max}$ Yel | $OD_{max}$ Mag | $OD_{max}$ Cy | $OD_{mid}$ Yel | $OD_{mid}$ Mag | $OD_{mid}$ Cy |
|---|---|---|---|---|---|---|---|---|---|
| Ex 1 | 52% | 40% | Good | 2.03 | 2.40 | 2.35 | 1.18 | 1.20 | 1.13 |
| Ex 2 | 38% | 40% | Good | 1.98 | 2.22 | 2.33 | 0.90 | 0.91 | 1.00 |

TABLE 2-continued

DYE TRANSFER EFFICIENCY

| Sample | Layer 2 Void Volume | Layer 3 Void Volume | Tearability | $OD_{max}$ Yel | $OD_{max}$ Mag | $OD_{max}$ Cy | $OD_{mid}$ Yel | $OD_{mid}$ Mag | $OD_{mid}$ Cy |
|---|---|---|---|---|---|---|---|---|---|
| Comp 1 | 49% | 40% | Good | 1.90 | 1.79 | 2.07 | 0.77 | 0.76 | 0.85 |
| Comp 2 | 39% | NA | Poor | 2.00 | 2.18 | 2.30 | 1.03 | 0.97 | 1.03 |
| Comp 3 | NA* | NA | Very Poor | NA* | NA* | NA* | NA* | NA* | NA* |
| Comp 4 | NA* | NA | Very Poor | NA* | NA* | NA* | NA* | NA* | NA* |

*No data/element tear

The data in Table 2 demonstrates that the use of the thermal dye transfer receiving element of the invention results in a high degree of manufacturability and improves dye-transfer efficiency. A greater amount of dye is transferred from dye donor elements used with receiving elements when using crosslinked organic microbeads in place of inorganic particles such as $BaSO_4$. Also, the manufacturability (non-tearability) of the microvoided thermal support is better with the presence of Layer 2 in combination with Layer 3.

The invention has been described in detail with particular reference to preferred embodiments thereof, but it will be understood that variations and modifications can be effected within the spirit and scope of the invention. The entire contents of the patents and other publications referred to in this specification are incorporated herein by reference.

What is claimed is:

1. A thermal dye-transfer dye-image receiving element comprising:

(a) a dye-receiving layer 1;

(b) beneath layer 1, a microvoided layer 2 containing a continuous phase polyester matrix having dispersed therein crosslinked organic microbeads, said layer 2 having a void volume of at least 25% by volume; and (c) beneath layer 2, a microvoided layer 3 comprised of a continuous phase polyester matrix having dispersed therein non-crosslinked polymer particles that are immiscible with the polyester matrix of layer 3.

2. The element of claim 1 wherein said dye-receiving layer 1 comprises a polymeric binder containing a polyester or polycarbonate.

3. The element of claim 1 wherein said dye-receiving layer 1 comprises a polyester and a polycarbonate polymer.

4. The element of claim 3 wherein said polyester and polycarbonate are present in the layer 1 in a weight ratio of 0.8–4.0 to 1.

5. The element of claim 1 wherein said dye-receiving layer 1 further comprises a polydimethylsiloxane-containing copolymer.

6. The element of claim 5 wherein said polydimethylsiloxane-containing copolymer is a polycarbonate random terpolymer of bisphenol A, diethylene glycol, and polydimethylsiloxane block unit and is present in an amount of from about 10% to about 30% by weight of the said dye-receiving layer 1.

7. The element of claim 1 wherein said dye-receiving layer 1 further comprises a plasticizer comprising an ester or polyester.

8. The element of claim 7 wherein said plasticizer is a mixture of 1,3-butylene glycol adipate and dioctyl sebacate in a combined total amount of from about 4% to about 20% by weight of the said dye-receiving layer 1.

9. The element of claim 1 wherein the microvoided layer 2 has a void volume of between 25% and 60 volume %.

10. The element of claim 1 wherein said microvoided layer 2 has a void volume of between 40% and 50%.

11. The element of claim 1 wherein said continuous phase polyester of said microvoided layer 2 comprises polyethylene(terephthalate) or a copolymer thereof.

12. The element of claim 1 wherein said continuous phase polyester of said microvoided layer 2 is a blend comprising polyethylene(terephthalate) and poly(1,4-cyclohexylene dimethyhlene terephthalate).

13. The element of claim 1 wherein said microvoided layer 2 has dispersed therein crosslinked organic microbeads comprising at least one of polystyrene, poly(methyl methacrylate), polyacrylamide, polyacrylonitrile, polyethylene glycol dimethacrylate, polyvinyl acetate, and polyvinylidene chloride.

14. The element of claim 1 wherein said microvoided layer 2 has dispersed therein crosslinked organic microbeads comprising a polystyrene, polyacrylate, polymethacrylate, or polyallylic polymer.

15. The element of claim 1 wherein said continuous phase polyester of said microvoided layer 3 comprises polyethylene(terephthalate) or copolymers thereof.

16. The element of claim 1 wherein said continuous phase polyester of said microvoided layer 3 comprises polyethylene(terephthalate).

17. The element of claim 1 wherein said immiscible polymeric particles have an olefinic backbone.

18. The element of claim 17 wherein said particles comprise polymers derived from a monomer selected from propylene, ethylene, and styrene.

19. The element of claim 18 wherein said polyolefin comprises polypropylene.

20. The element of claim 1 wherein said microvoided layer 3 has a density of less than 0.95 grams/cc.

21. The element of claim 20 wherein said microvoided layer 3 has a density of between 0.4 and 0.85 grams/cc.

22. The element of claim 1 wherein said microvoided base layer 3 has a void volume of greater than 30 volume %.

23. The element of claim 22 wherein said microvoided base layer 3 has a void volume of 35–55%.

24. The element of claim 1 wherein there is located beneath layer 3 a paper support.

25. The element of claim 1 wherein the one or more subbing layers are present between layers.

26. The element of claim 1 wherein no subbing layers are employed between the layers.

27. The element of claim 1 wherein the total thickness of layers 1, 2, and 3 of the element is from 20 to 400 micrometers.

28. The element of claim 1 wherein the total thickness of layers 1, 2, and 3 of the element is from 30 to 300 micrometers.

29. The element of claim 1 wherein the total thickness of layers 1, 2, and 3 of the element is from 50 to 200 micrometers.

30. A thermal dye transfer assemblage comprising a dye-donor element, and the dye-receiving element of claim 1.

31. A method of forming an image comprising imagewise thermally transferring dyes onto the element of claim 1.

* * * * *